US009543081B2

(12) United States Patent
Ozil et al.

(10) Patent No.: US 9,543,081 B2
(45) Date of Patent: Jan. 10, 2017

(54) ELECTRICAL APPARATUS WITH DUAL MOVEMENT OF CONTACTS COMPRISING A RETURN DEVICE WITH TWO LEVERS

(71) Applicant: Alstom Technology Ltd., Baden (CH)

(72) Inventors: Joël Ozil, St André de Corcy (FR); Ludovic Darles, Lyons (FR); Benjamin Coda, Villeurbanne (FR); Cyril Gregoire, Lyons (FR)

(73) Assignee: ALSTOM TECHNOLOGY LTD, Baden (CH)

( * ) Notice: Subject to any disclaimer, the term of this patent is extended or adjusted under 35 U.S.C. 154(b) by 0 days.

(21) Appl. No.: 14/762,638

(22) PCT Filed: Jan. 21, 2014

(86) PCT No.: PCT/EP2014/051128
§ 371 (c)(1),
(2) Date: Jul. 22, 2015

(87) PCT Pub. No.: WO2014/114637
PCT Pub. Date: Jul. 31, 2014

(65) Prior Publication Data

US 2015/0357128 A1 Dec. 10, 2015

(30) Foreign Application Priority Data

Jan. 24, 2013 (FR) ..... 13 50612

(51) Int. Cl.
*H01H 25/00* (2006.01)
*H01H 3/46* (2006.01)
(Continued)

(52) U.S. Cl.
CPC ..... *H01H 3/46* (2013.01); *H01H 33/904* (2013.01); *H01H 2033/028* (2013.01)

(58) Field of Classification Search
CPC ..... H01H 2033/028; H01H 33/904; H01H 33/905; H01H 33/42; H01H 3/32; H01H 3/46
(Continued)

(56) References Cited

U.S. PATENT DOCUMENTS 5,561,280 A 10/1996 Blatter
6,049,050 A * 4/2000 David ..... H01H 3/36 218/154
(Continued)

FOREIGN PATENT DOCUMENTS

DE 100 03 357 C1 7/2001
EP 0 689 218 A1 12/1995
(Continued)

OTHER PUBLICATIONS

Search Report issued in French Patent Application No. 13 50612 dated Nov. 20, 2013.
(Continued)

*Primary Examiner* — Vanessa Girardi
(74) *Attorney, Agent, or Firm* — Pearne & Gordon LLP

(57) ABSTRACT

The invention provides electric power line switchgear (10) comprising a main movable contact (14) and a secondary movable contact (16), capable of moving along a main axis A of the switchgear (10), in which the main movable contact (14) is connected to the secondary movable contact (16) by means of a crank mechanism (20) that transforms the movement of the main movable contact (14) in one direction into a movement of the secondary movable contact (16) in an opposite direction; the switchgear being characterized in that the crank mechanism (20) comprises two levers (22, 24) mounted to pivot relative to the stationary housing (12) about respective parallel pivot axes (B, C), each lever (22, 24) being connected firstly to a respective one of the main
(Continued)

movable contact (14) and the secondary movable contact (16), and secondly to the other lever (24, 22).

11 Claims, 5 Drawing Sheets

(51) Int. Cl.
*H01H 33/90* (2006.01)
*H01H 33/02* (2006.01)

(58) Field of Classification Search
USPC ..... 200/337; 218/7, 14, 92, 93, 78, 140, 154
See application file for complete search history.

(56) References Cited

U.S. PATENT DOCUMENTS

| | | | | |
|---|---|---|---|---|
| 7,642,480 | B2 * | 1/2010 | Ozil | H01H 33/904 200/258 |
| 7,777,149 | B2 * | 8/2010 | Bourgeois | H01H 33/904 218/14 |
| 2006/0151438 | A1 | 7/2006 | Urai | |
| 2013/0126481 | A1 | 5/2013 | Ozil | |

FOREIGN PATENT DOCUMENTS

| | | | |
|---|---|---|---|
| EP | 0 809 269 | A2 | 11/1997 |
| EP | 0 992 050 | | 4/2000 |
| EP | 1 933 348 | A1 | 6/2008 |
| FR | 2 491 675 | A1 | 4/1982 |
| JP | H03-40324 | A | 2/1991 |
| WO | 99/00814 | A1 | 1/1999 |
| WO | 2012/155952 | A1 | 11/2012 |

OTHER PUBLICATIONS

International Search Report issued in Application No. PCT/EP2014/051128 dated Mar. 21, 2014.

* cited by examiner

ELECTRICAL APPARATUS WITH DUAL MOVEMENT OF CONTACTS COMPRISING A RETURN DEVICE WITH TWO LEVERS

TECHNICAL FIELD

The invention relates to electric power line switchgear, such as a high- or medium-voltage disconnector or circuit breaker with dual-motion contacts, including a main movable contact and a secondary movable contact, together with a connection mechanism for connecting the two movable contacts together and enabling the secondary movable contact to be driven by the main movable contact.

The invention relates more particularly to a circuit breaker or a disconnector for which driving of the secondary movable contact is optimized in order to limit the stroke and in order to optimize acceleration of the secondary movable contact during a stage of opening the switchgear.

STATE OF THE PRIOR ART

A circuit breaker with dual motion contacts includes two contacts that are capable of moving relative to each other and relative to a stationary structure during a stage of opening or closing the circuit breaker.

In general, one of the two movable contacts, commonly referred to as the main movable contact, is driven by a drive mechanism, and it drives the other movable contact, commonly referred to as the secondary movable contact, by means of a crank mechanism.

That crank mechanism is generally designed so that the movement of the secondary movable contact is simultaneous and opposite to the movement of the main movable contact.

Documents EP-A-1 933 348 and EP-A-0 809 269 each describe a disconnector with dual motion contacts that has a system comprising two rods and a central crank member by means of which the main movable contact drives the secondary movable contact.

During opening of the disconnector, the main movable contact and the secondary movable contact move simultaneously in opposite directions.

The drive mechanism of the movable contact must therefore be capable of producing energy that is sufficiently great in order to move both movable contacts simultaneously. That energy is therefore relatively great at the start of the stage of opening the disconnector.

In addition, the drive mechanism provides energy that enables the movable contacts to quickly reach a speed that is sufficiently great in order to extinguish an electric arc that forms between the two movable contacts.

Thus, the dimensions of the components of the drive mechanism, of the movable contacts, and of the crank mechanism are relatively great in order to be able to resist the loads involved during opening or closing of the disconnector.

Document EP-B-0 992 050 describes a connection system for connecting the main movable contact with the secondary movable contact comprising a traction rod constrained to the main movable contact, a pivoting lever, and a connection part fastened to the secondary movable contact.

One branch of the lever is fork-shaped and is capable of co-operating with a pin carried by the traction rod. The other branch of the lever carries a pin that co-operates with a notch in the connection part.

The co-operation of the pin carried by the traction rod with the fork of the lever enables the secondary movable contact to remain stationary in a first period of the opening stage, and then to be driven by the main movable contact in a second period of the opening stage. Thus, the energy necessary for setting the movable contacts into movement is distributed over time.

However, the acceleration of each movable contact is continuous, and the speeds of the movable contacts are highest at positions that are different from the positions in which the electric arc between the contacts needs to be extinguished.

The invention aims to provide switchgear such as a disconnector for which the connection means for connecting the movable contacts together make it possible to limit the drive forces of the movable contacts, while making it possible to have a relative speed of one contact relative to the other that is at a maximum when the contact between the movable contacts is on the point of being broken.

SUMMARY OF THE INVENTION

The invention provides electric power line switchgear comprising a main movable contact and a secondary movable contact, each of which is capable of moving relative to a stationary housing of the switchgear along a main axis of the switchgear between a closed position of the switchgear and an open position of the switchgear, wherein the main movable contact is connected to the secondary movable contact by means of a crank mechanism that transforms the movement of the main movable contact in one direction into a movement of the secondary movable contact in a direction opposite the direction of movement of the main movable contact;

the switchgear being characterized in that the crank mechanism comprises two levers mounted to pivot relative to the stationary housing about respective parallel pivot axes, each lever being connected firstly to the main movable contact or the secondary movable contact, and secondly to the other lever.

Driving of the secondary movable contact by means of a crank mechanism having two levers mounted in series makes it possible to optimize the stroke and the speed of movement of the secondary movable contact as a function of the position of the main movable contact during a stage of opening the switchgear.

Preferably, the crank mechanism is made in such a manner that when the main movable contact moves between a first position corresponding to the closed position of the switchgear and an intermediate position, the crank mechanism doesn't transform the movement of the main movable contact in a movement of the secondary movable contact and when the main movable contact moves between said intermediate position and a third position corresponding to the open position of the switchgear, the crank mechanism transforms the movement of the main movable contact in a movement of the secondary movable contact.

Preferably, a first lever of the crank mechanism comprises a first branch that is connected to the main movable contact and a second branch that is connected to a second lever of the crank mechanism, and the second lever comprises a first branch that is connected to the second branch of the first lever and a second branch that is connected to the secondary movable contact.

Preferably, the first branch of the second lever includes a slot in which a follower pin, secured to the second branch of the first lever is capable of moving during pivoting of the first lever.

Preferably, the slot includes a first portion that is of circularly arcuate shape centered on the pivot axis of the first lever relative to the housing when the second lever is in its closed position of the switchgear.

Preferably, the follower pin moves in the first portion of the slot when the main movable contact moves between said first position and said intermediate position.

Preferably, the slot comprises a second portion in which the follower pin moves when the main movable contact moves between said intermediate position and said third position to drive the second lever in rotation about its pivot axis.

Preferably, the shape of the second portion of the slot is defined in such a manner that when the main movable contact moves from said intermediate position to said third position, the pivot speed of the second lever increases progressively.

Preferably, the shape of the second portion of the slot is defined in such a manner that when the main movable contact moves from said intermediate position to said third position, the pivot speed of the second lever increases progressively and then reduces progressively.

Preferably, the speed of the main contact is greater than the speed of the secondary movable contact when the main movable contact moves from said intermediate position to said third position.

Preferably, the speed of the main contact is less than or equal to the speed of the secondary movable contact then is greater than the speed of the secondary movable contact when the main movable contact moves from said intermediate position to said third position.

BRIEF DESCRIPTION OF THE DRAWINGS

Other characteristics and advantages of the invention appear on reading the following detailed description, which can be better understood with reference to the accompanying drawings, in which.

DETAILED DESCRIPTION OF PARTICULAR EMBODIMENTS

Figure 1:
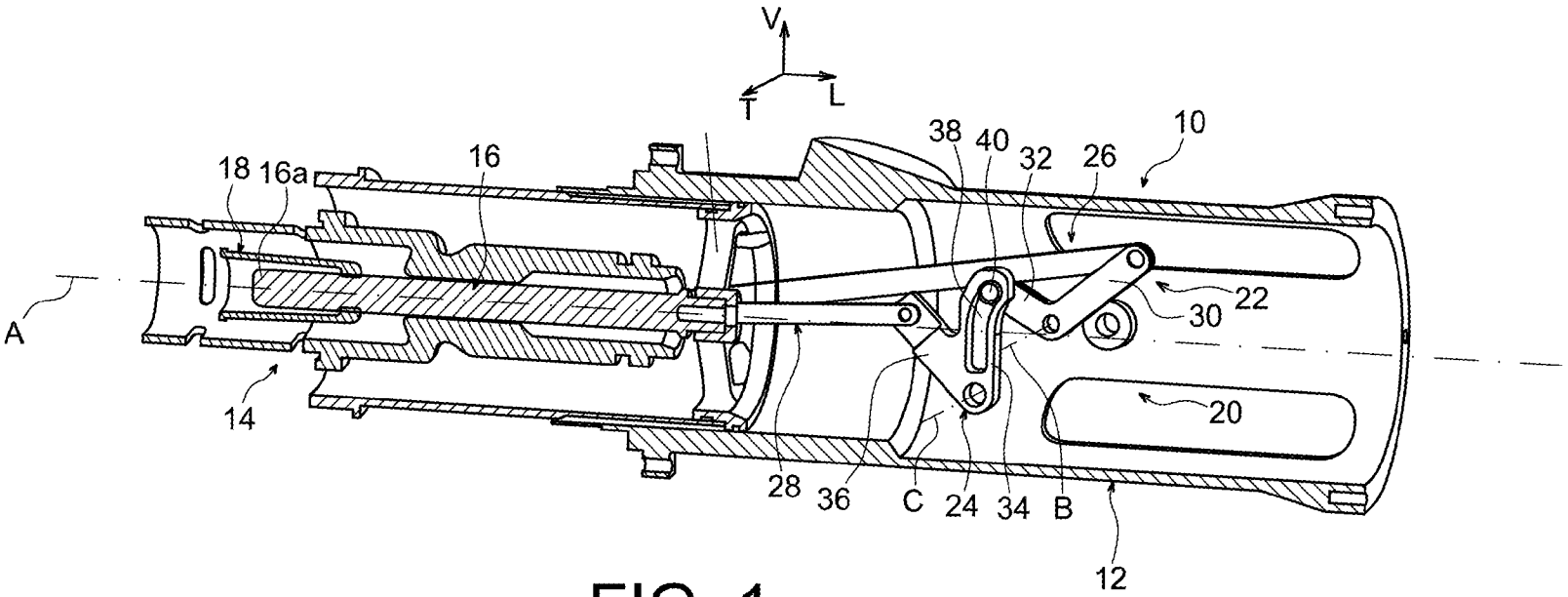
FIG. 1 is a perspective diagram of an arc-control chamber for switchgear, made in accordance with the teaching of the invention.

In the description of the invention, the longitudinal, vertical, and transverse orientations are given the references L, V, and T in non-limiting manner, and as shown in FIG. 1.

FIG. 1 shows switchgear 10 such as for example, an arc-control chamber of a circuit breaker of a medium- or high-voltage electricity transmission line.

The arc-control chamber 10 comprises a stationary housing 12 of shape that is mainly cylindrical about a main axis A that is oriented longitudinally in this embodiment. The arc-control chamber 10 also includes, arranged inside the housing 12, a main movable contact 14 and a secondary movable contact 16 arranged on the same axis as the housing 12. The main movable contact and the secondary movable contact 16 are mounted to move relative to the housing 12 by sliding axially along the main axis A of the housing 12.

In this embodiment, the secondary movable contact 16 consists in an axial rod having an axial end 16*a* that is suitable for being received in a contact portion 18 of the main movable contact 14.

Figure 3A:
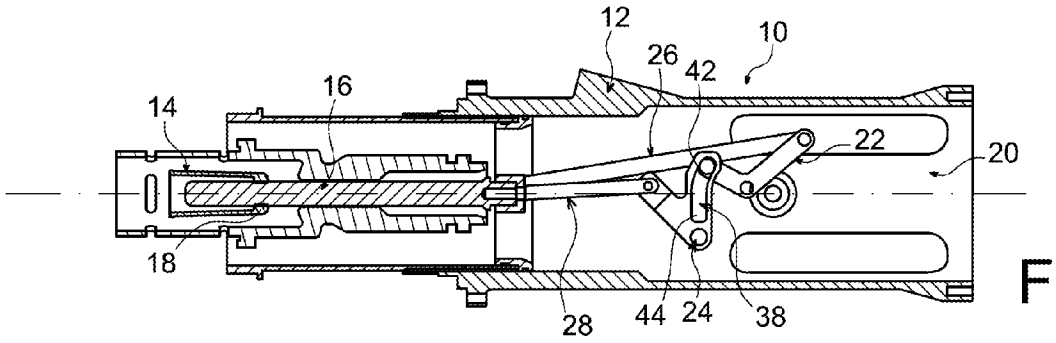
FIGS. 3A to 3D are elevation views showing successive states of the arc-control chamber during a stage of opening the switchgear.
Figure 3B:
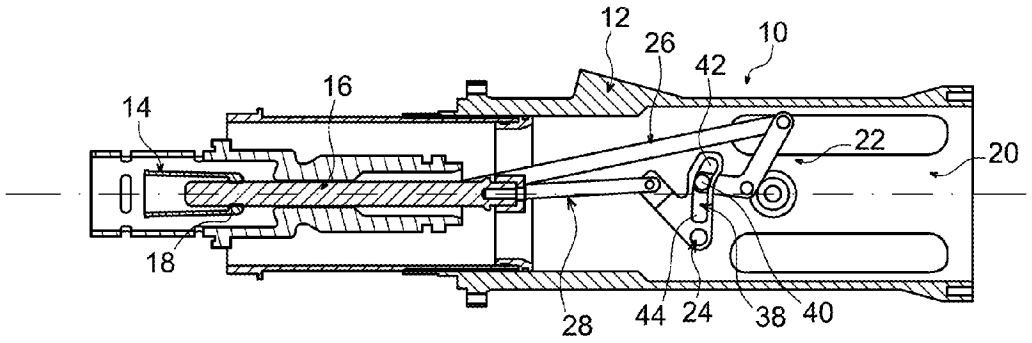
Figure 3C:
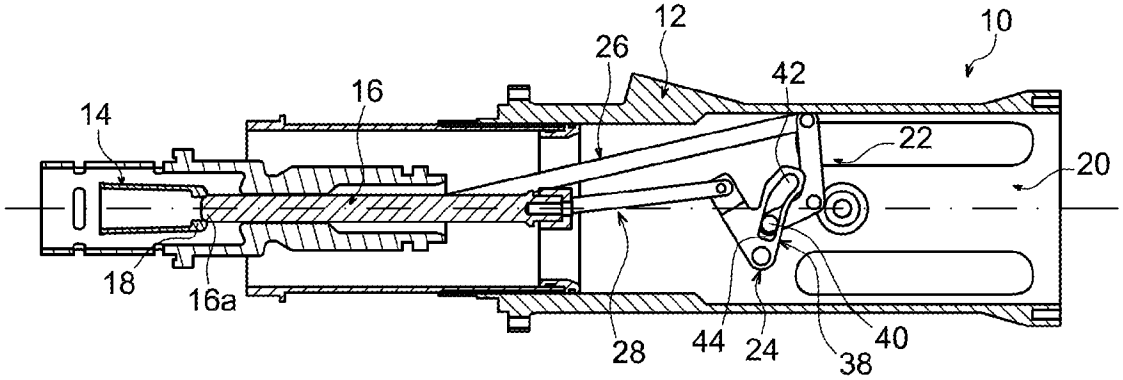
Figure 3D:
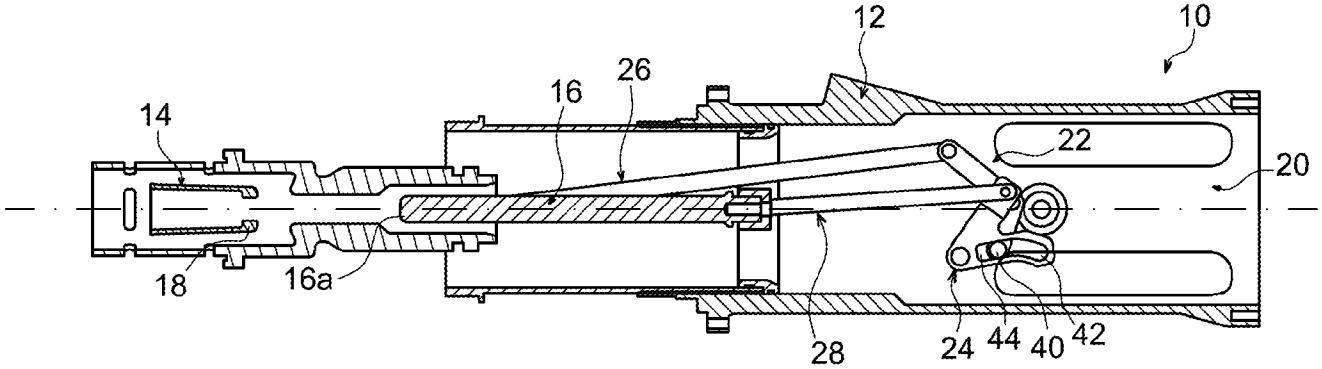

Each movable contact 14, 16 is electrically connected to an electrical conductor and the movable contacts 14, 16 are suitable for being moved axially in the housing 12 between a closed position shown in FIG. 1, in which the movable contacts 14, 16 are in contact with each other in order to enable an electric current to flow through the arc-control chamber 10, and an open position shown in FIG. 3D in which the movable contacts 14, 16 are situated at a distance from each other, preventing any flow of electric current in the arc-control chamber 10.

The movable contacts 14, 16 are moved by drive means (not shown) that are connected to the main movable contact 14 and by a crank mechanism 20 that connects the main movable contact 14 to the secondary movable contact 16.

The crank mechanism 20 serves to transmit the driving force coming from the drive means to the secondary movable contact 16 via the main movable contact 14.

The crank mechanism 20 is also designed to transform the movement of the main movable contact 14 in a first direction into a movement of the secondary movable contact 16 in a direction that is opposite relative to the main movable contact 14.

As can be seen in FIGS. 3A to 3D, during a stage of opening the arc-control chamber 10, the main movable contact 14 is driven to move axially in a first direction, which, with reference to the figures, is to the left in this embodiment, and the secondary movable contact 16 is driven to move axially in a second direction that is opposite, i.e. to the right in this embodiment.

Figure 2A:
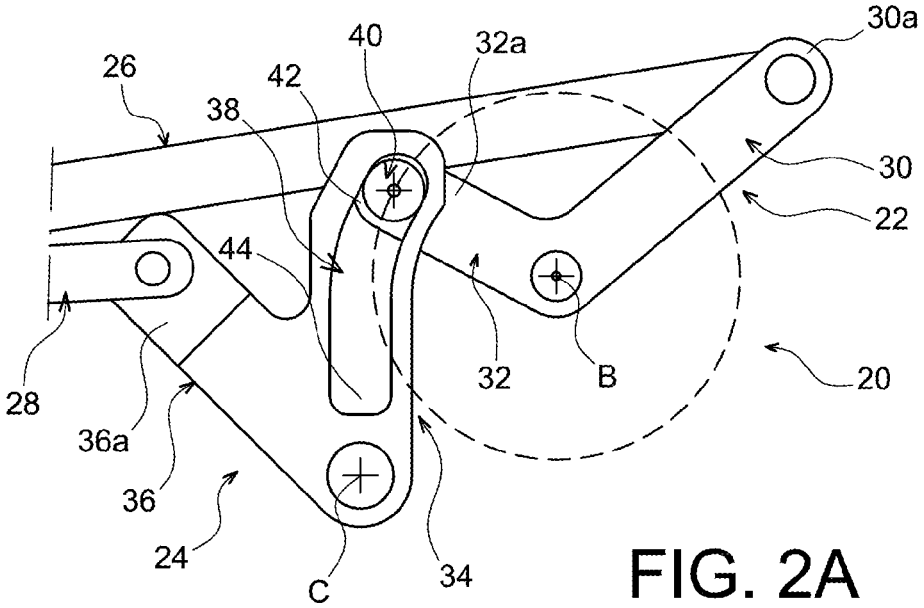
FIGS. 2A and 2B show details on a larger scale of the crank mechanism shown in FIG. 1.
Figure 2B:
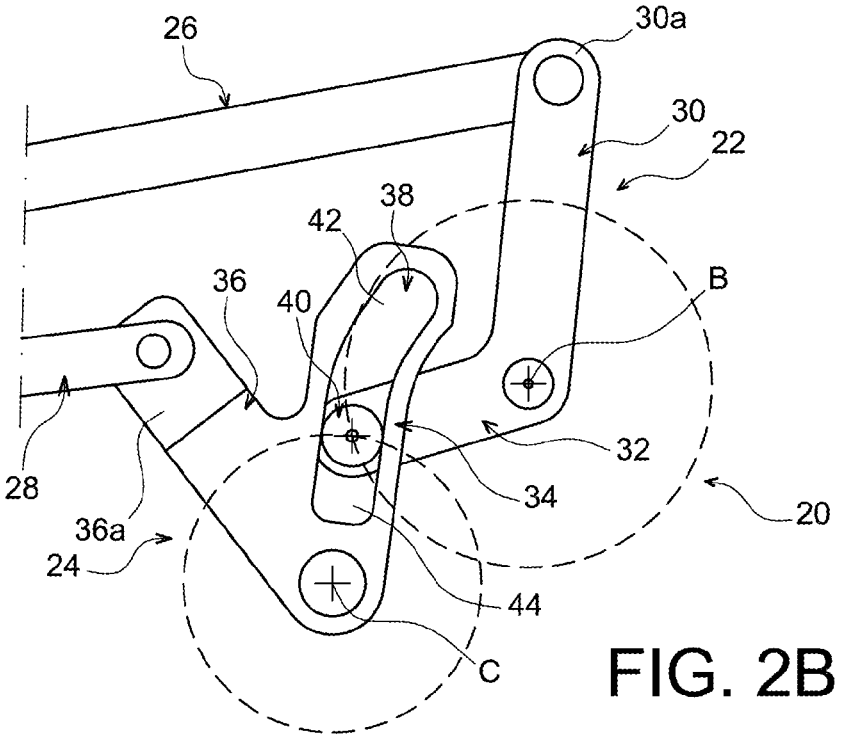

As can be seen in more detail in FIGS. 2A and 2B, the crank mechanism 20 comprises two levers 22, 24 that are connected to each other in series, that are mounted to pivot relative to the housing 12 about associated parallel transverse axes B, C, and also two rods 26, 28 that connect the levers 22, 24 to the movable contacts 14, 16.

A first rod 26 connects the main movable contact 14 to a first lever 22 and the second rod 28 connects the second lever 24 to the secondary movable contact 16.

The first lever 22 is made up of two branches 30, 32 that are connected to each other at the pivot axis B of the first lever 22. The first lever 22 thus comprises a first branch 30 with a free end 30*a* that is connected to the main movable contact by means of the first rod 26, and a second branch 32 with a free end 32*a* that is connected to the second lever 24.

The second lever 24 is also made up of two branches 34, 36 that are connected to each other at the pivot axis C of the second lever 24. The second lever 24 thus comprises a first branch 34 that is connected to the second branch 32 of the first lever 22, and a second branch 36 having a free end 36*a* that is connected to the secondary movable contact 16 by means of the second rod 28.

The first branch 34 of the second lever 24 includes a slot 38 movably receiving a follower pin 40 that is carried by the second branch 32 of the first lever 22.

The shape of the slot 38 is defined so that during a stage of opening the arc-control chamber 10, in a first period of that opening stage, the main movable contact 14 moves along the longitudinal main axis A and the secondary movable contact 16 remains stationary and then, in second and third periods of said opening stage, the main movable contact 14 drives the secondary movable contact 16 to move along the longitudinal main axis A.

Also, the shape of the slot 38 is defined so that the main movable contact 14 drives the secondary movable contact 16 when the main movable contact 14 is situated between its chamber-open position and an intermediate position situated between the open position and the closed position of the arc-control chamber 10.

When the main movable contact 14 is in this intermediate position, the two movable contacts 14, 16 may or may not be electrically connected together.

Thus, in this first period in the stage of opening the arc-control chamber 10, only the main movable contact 14 moves, the energy necessary for moving said single movable contact 14 is therefore less than the energy necessary for moving both movable contacts 14, 16. Also, the overall size of the housing 12 of the arc-control chamber 10 is limited since the stroke of the secondary movable contact 16 is limited.

To this end, the slot 38 includes a first portion 42 that is of circularly arcuate shape centered on the pivot axis B of the first lever 22 when the second lever 24 is in its switchgear-closed position. This first portion 42 of the slot 38 is the radially outer portion of the slot 38 relative to the pivot axis C of the second lever 24.

When the follower pin 40 moves in the first portion 42 of the slot 38, and the secondary movable contact 16 is in its initial position in which the arc-control chamber 10 is closed, as can be seen for example in FIG. 2A, the follower pin 40 does not press against the walls of the slot 38, the second lever 24 is thus not driven to pivot by the first lever 22.

The slot 38 includes a second portion 44 that extends the first portion 42, and that is of a shape that is defined in such a manner that when the follower pin 40 moves in this second portion 44 of the slot 38, it presses against one of the walls of the slot 38.

The second lever 24 is thus driven to pivot by the first lever 22 and consequently it drives the secondary movable contact 16 to move relative to the housing 12.

In this embodiment, and as can be seen in FIG. 2B, the second portion 44 of the slot 38 is generally rectilinear and extends radially relative to the pivot axis C of the second lever. It should be understood that the invention is not limited to this shape for the second portion 44, which portion may also be curved without going beyond the ambit of the invention.

FIGS. 3A to 3D show various consecutive actuation positions of the arc-control chamber 10 of the invention, during a stage of opening of the arc-control chamber 10.

In FIG. 3A, the arc-control chamber 10 is shown in its initial closed position in which the movable contacts 14, 16 are electrically connected together and in which each of the movable contacts 14, 16 is in an initial closed position, enabling electric current to flow through the arc-control chamber 10.

During the opening stage, the main movable contact 14 is driven in continuous manner by the drive means in axial movement along the main axis A of the arc-control chamber, in this embodiment towards the left, from its initial closed position shown in FIG. 3A, until it reaches its final position in which the arc-control chamber is open as shown in FIG. 3D.

In its axial movement, the main movable contact 14 acts by means of the first rod 26 to drive the first lever 22 to pivot about its pivot axis B.

The follower pin 40 thus describes a circularly arcuate trajectory centered on the pivot axis B of the first lever 22.

In a first period during the stage of opening the arc-control chamber 10, corresponding to the passage from the state shown in FIG. 3A to the state shown in FIG. 3B, the main movable contact 14 moves along a certain stroke.

During this first period, the follower pin 40 moves in the first portion 42 of the slot 38. The second lever is in a position corresponding to the initial closed position of the secondary movable contact 16. Thus, the circular arc formed by the first portion 42 of the slot 38 is centered on the pivot axis B of the first lever 22.

Thus, as mentioned above, during this first period of the opening stage, the second lever 24 is not driven to pivot about its pivot axis C by the first lever 22, so the secondary movable contact 16 remains stationary in its initial chamber-closed position. Consequently, during said first period of the opening stage, only the main movable contact 14 is moved axially.

At the end of the first period of the opening stage, in an intermediate position of the main movable contact 14 shown in FIG. 3B, only the main movable contact 14 is axially offset relative to its initial position in which the arc-control chamber 10 is closed, while the secondary movable contact 16 is still in its initial closed position.

In a second period of the opening stage, corresponding to the passage from the state shown in FIG. 3B to the state shown in FIG. 3C, the main movable contact 14 continues its axial movement, passing through the above-described intermediate position. The main movable contact 14 thus drives the first lever 22 and therefore also the follower pin 40 to pivot about the pivot axis B of the first lever.

During said second period, the follower pin 40 moves in the second portion 44 of the slot 38.

The shape of the second portion 44 of the slot 38 and the circularly arcuate trajectory of the follower pin 40 result in the follower pin 40 pressing on a wall of the second portion 44 of the slot 38, thereby driving the second lever 24 to pivot about its axis C in a direction opposite to the direction of rotation of the first lever 22 pivoting about its axis B. In this embodiment the second lever 24 therefore pivots in a clockwise direction.

While pivoting, the second lever 24 drives the secondary movable contact 16 to slide relative to the housing 12 in a direction opposite to the sliding direction of the main movable contact 14, i.e. in this embodiment towards the right when looking at the figures.

The arrangement of the pivot axes B, C of the levers 22, 24 relative to the housing 12, and the orientations and dimensions of the branches of the levers 22, 24 are defined in such a manner that during said second period of the opening stage, the follower pin 40 moves progressively closer to the pivot axis C of the second lever 24.

As a result of getting closer to the pivot axis C of the second lever 24, the angle of inclination between the trajectory of the follower pin 40 and the first branch 34 of the second lever 24 increases.

Consequently, via a system of lever arms, the speed of pivoting of the second lever 24 increases progressively during said second period of the opening stage.

Thus, the speed at which the secondary movable contact 16 moves also increases progressively during the second period of the opening stage.

During said second period of the opening stage, both movable contacts 14, 16 move simultaneously and in opposite directions. Also, at least the movement speed of the secondary movable contact 16 increases progressively.

Furthermore, the strokes of the movable contacts 14, 16 are defined in such a manner that the electrical connection between the contacts 14, 16 is broken when the relative speed between the movable contacts 14, 16 is at its greatest, or at any other position before or during the acceleration stage of the secondary movable contact 16.

Preferably, at the end of the second period of the opening stage, the movable contacts are separate and the follower pin 40 is situated between the two pivot axes B, C of the levers. The follower pin 40 is in its position that is closest to the pivot axis C of the second lever 24.

At that instant, the relative speed between the movable contacts 14, 16 is at a maximum, promoting extinction of the electric arc.

Then, during a third period of the stage of opening the arc-control chamber 10, corresponding to the passage from the state shown in FIG. 3C to the state shown in FIG. 3D, the movable contacts continue their movements in opposite directions.

The follower pin 40 moves in the slot 38 and moves progressively further away from the pivot axis C of the second lever, and the pivoting speed of the second lever 24 is thus reduced progressively.

Consequently, during the third period of the opening stage, the secondary movable contact 16 slows down progressively relative to its maximum speed of movement.

At the end of the third period of the opening stage, which is also the end of the opening stage, the drive means of the main movable contact 14 are stopped, and consequently the main movable contact 14 is stopped, as is the secondary movable contact 16.

Since the secondary movable contact 16 slows down progressively during said third period of the opening stage, its kinetic energy is reduced, and the energy necessary for stopping the secondary movable contact 16 is consequently also reduced.

Thus, by means of the double lever crank system 20 and the particular shape of the slot 38, the main movable contact 14 drives the secondary movable contact 16 when the main movable contact 14 is in an axial position situated between the open position of the arc-control chamber 10 and the intermediate position shown in FIG. 3B. Also, the main movable contact 14 does not drive the secondary movable contact 16 when the main movable contact 14 is in an axial position situated between the closed position of the arc-control chamber 10 and the intermediate position shown in FIG. 3B.

Figure 4:
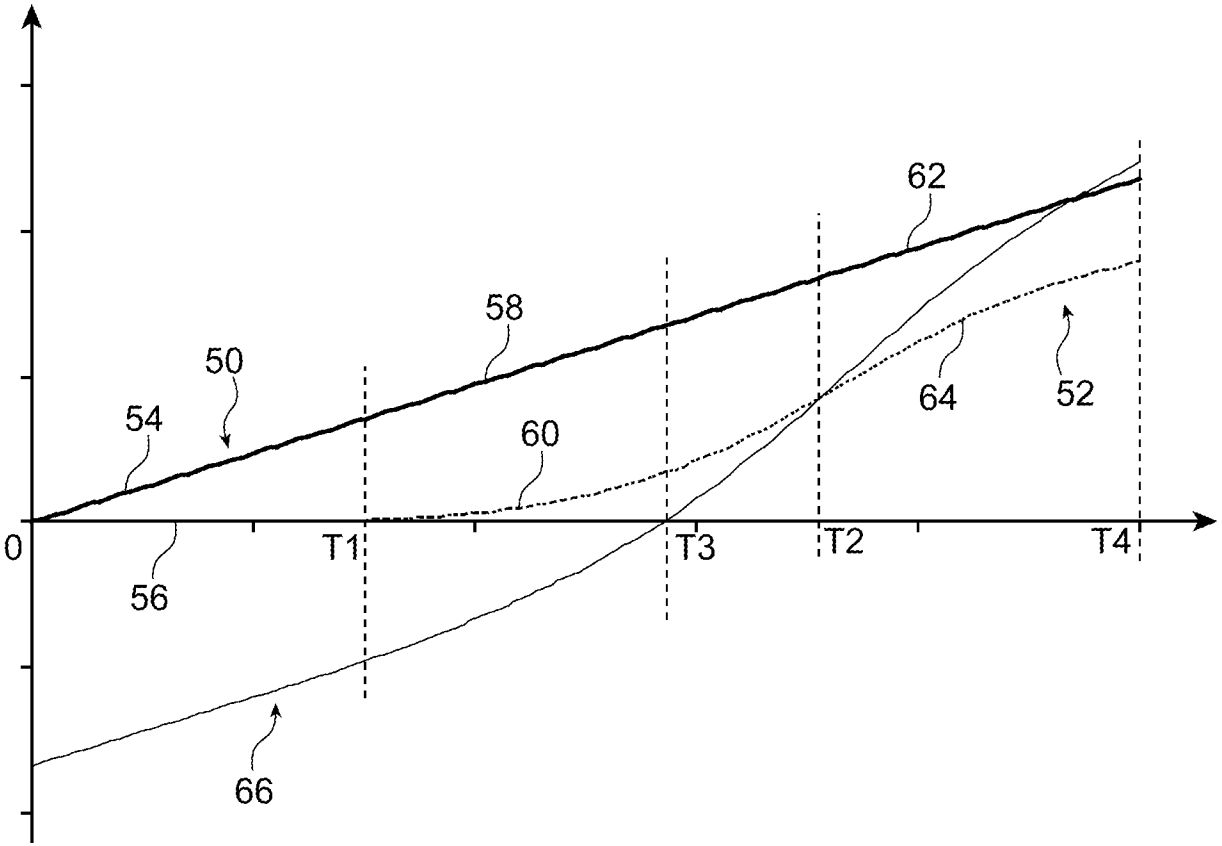
FIG. 4 is a graph showing the movement of each movable contact relative to the housing of the switchgear during a stage of opening the switchgear in an embodiment of the invention.

FIG. 4 is a graph showing the movement, or the stroke, of each movable contact 14, 16 relative to the housing 12, during the opening stage, for an embodiment of the invention.

A first curve 50 of the graph is rectilinear and shows the stroke of the main movable contact 14 relative to the housing. A second curve 52, that is not rectilinear, shows the stroke of the secondary movable contact 16 relative to the housing 12.

A third curve 66 shows the relative distance between the two movable contacts 14, 16.

Each curve 50, 52 includes a first portion 54, 56 corresponding to the movement of the associated movable contact 14, 16 during the first period of the opening stage, i.e. until it reaches an instant T1.

During this first period, as mentioned above, only the main movable contact 14 moves, the secondary movable contact 16 remains stationary.

That is why the first portion 56 of the curve 52 associated with the secondary movable contact 16 is rectilinear and coincides with the abscissa axis.

Each curve 50, 52 also includes a first portion 58, 60 corresponding to the movement of the associated movable contact 14, 16 during the second period of the opening stage, i.e. from an instant T1 until it reaches an instant T2.

During said second period of the opening stage, the main movable contact 14 drives the secondary movable contact 16 and the speed of movement of the secondary movable contact 16 increases progressively.

That is why the second portion 60 of the curve 52 associated with the secondary movable contact 16 is concave with its concave side facing upwards.

As can be seen in the third curve 66, the two movable contacts 14, 16 lose contact with each other during said second period, at instant T3 at which the curve 66 intersects the abscissa axis.

At instant T2, i.e. at the end of the second period of the opening stage the speed of the secondary movable contact 16 is at a maximum.

After said instant T2, i.e. during the third period of the opening stage, the speed of the secondary movable contact 16 is reduced progressively.

Each curve 50, 52 thus includes a third portion 62, 64 corresponding to the movement of the associated movable contact 14, 16 during the third period of the opening stage, i.e. from the instant T2 until it reaches an instant T4.

The third portion 64 of the curve 52 associated with the secondary movable contact 16 is concave with its concave side facing upwards, and the curve 52 includes a point of inflection at the moment corresponding to the instant T2.

In yet another aspect of the invention, the dimensions of the levers 22, 24 are defined so that the speed of the main contact 14 is greater than the speed of the secondary movable contact 16 during the second period of the opening stage, and during the third period of the opening stage.

In a variant of this other aspect of the invention, the dimensions of the levers 22, 24 are defined so that the speed of the main contact 14 is less than or equal to the speed of the secondary movable contact 16 during the second period of the opening stage, and so that the speed of the main movable contact 14 is greater than the speed of the secondary movable contact 16 during the third period of the opening stage.

Closure of the arc-control chamber 10 takes place by a movement that is the opposite of the movement that is described above, i.e. by passing from the state shown in FIG. 3D to the state shown in FIG. 3A.

Initially, corresponding to the passage from the state shown in FIG. 3D to the state shown in FIG. 3B and passing through the state shown in FIG. 3C, the drive means drive the main movable contact 14 in movement along the axis A of the housing 12 so that it moves closer to the secondary movable contact 16.

The secondary movable contact 16 is driven by the main movable contact 14 via the crank mechanism 20, to move in the direction opposite to the main movable contact 14, i.e. the movable contacts 14, 16 move closer to each other, and then make electrical contact.

The arc-control chamber 10 is thus closed.

The movable contacts 14, 16 move beyond this contact position, until they reach the relative position corresponding to the state shown in FIG. 3B, in which the secondary movable contact 16 is in its closed position of the arc-control chamber 10.

In this state, the second lever 24 is in its angular position relative to its pivot axis C for which the circular arc formed by the first portion 42 of the slot 38 is centered on the pivot axis B of the first lever 22. Also, in this state, the follower pin 40 reaches the first portion 42 of the slot 38.

Then, in a second period of the stage during which the arc-control chamber 10 is closed, the movable contact continues its movement, driving the first lever 22, and therefore also the follower pin 40.

The follower pin 40 moves in the first portion 42 of the slot 38, the second lever 24 is thus not driven to pivot by the first lever 22.

The secondary movable contact 16 consequently remains stationary.

At the end of said second period, which is also the end of the closing stage the arc-control chamber 10 is in the state shown in FIG. 3A and the drive means of the main movable contact 14 are stopped.

What is claimed is:

1. Electric power line switchgear (10) comprising a main movable contact (14) and a secondary movable contact (16), each of which is capable of moving relative to a stationary housing of the switchgear along a main axis A of the switchgear (10) between a closed position of the switchgear (10) and an open position of the switchgear (10);

wherein the main movable contact (14) is connected to the secondary movable contact (16) by means of a crank mechanism (20) that transforms the movement of the main movable contact (14) in one direction into a movement of the secondary movable contact (16) in a direction opposite the direction of movement of the main movable contact;

the switchgear being characterized in that the crank mechanism (20) comprises two levers (22, 24) mounted to pivot relative to the stationary housing (12) about respective parallel pivot axes (B, C), each lever (22, 24) being connected firstly to the main movable contact (14) or the secondary movable contact (16), and secondly to the other lever (24, 22).

2. Switchgear (10) according to claim 1, characterized in that the crank mechanism (20) is made in such a manner that when the main movable contact (14) moves between a first position corresponding to the closed position of the switchgear (10) and an intermediate position, the crank mechanism (20) doesn't transform the movement of the main movable contact (14) in a movement of the secondary movable contact (16) and when the main movable contact (14) moves between said intermediate position and a third position corresponding to the open position of the switchgear (10), the crank mechanism (20) transforms the movement of the main movable contact (14) in a movement of the secondary movable contact (16).

3. Switchgear (10) according to claim 2, characterized in that a first lever (22) of the crank mechanism (20) comprises a first branch (30) that is connected to the main movable contact (14) and a second branch (32) that is connected to a second lever of the crank mechanism (20), and the second lever (24) comprises a first branch (34) that is connected to the second branch (32) of the first lever (22) and a second branch (36) that is connected to the secondary movable contact (16).

4. Switchgear (10) according to claim 3, characterized in that the first branch (34) of the second lever (24) includes a slot (38) in which a follower pin (40) secured to the second branch (32) of the first lever (22) is capable of moving during pivoting of the first lever (22).

5. Switchgear (10) according to claim 4, characterized in that the slot (38) comprises a first portion (42) that is of circularly arcuate shape centered on the pivot axis (B) of the first lever (22) relative to the housing (12) when the second lever (24) is in its closed position of the switchgear (10).

6. Switchgear (10) according to claim 5, characterized in that the follower pin (40) moves in the first portion (42) of the slot (38) when the main movable contact (14) moves between said first position and said intermediate position.

7. Switchgear (10) according to claim 6, characterized in that the slot (38) comprises a second portion (44) in which the follower pin moves when the main movable contact (14) moves between said intermediate position and said third position to drive the second lever (24) in rotation about its pivot axis (C).

8. Switchgear (10) according to claim 7, characterized in that the shape of the second portion (44) of the slot (38) is defined in such a manner that when the main movable contact (14) moves from said intermediate position to said third position , the pivot speed of the second lever (24) increases progressively.

9. Switchgear (10) according to claim 7, characterized in that the shape of the second portion (44) of the slot (38) is defined in such a manner that when the main movable contact (14) moves from said intermediate position to said third position, the pivot speed of the second lever (24) increases progressively and then reduces progressively.

10. Switchgear (10) according to claim 9, characterized in that the speed of the main contact (14) is greater than the speed of the secondary movable contact (16) when the main movable contact (14) moves from said intermediate position to said third position.

11. Switchgear (10) according to claim 9, characterized in that the speed of the main contact (14) is less than or equal to the speed of the secondary movable contact (16) then is greater than the speed of the secondary movable contact (16) when the main movable contact (14) moves from said intermediate position to said third position.

* * * * *